US011749164B2

(12) United States Patent
Pyun et al.

(10) Patent No.: US 11,749,164 B2
(45) Date of Patent: Sep. 5, 2023

(54) DRIVING CONTROLLER, DISPLAY APPARATUS HAVING THE SAME AND METHOD OF DRIVING DISPLAY PANEL USING THE SAME

(71) Applicant: Samsung Display Co., LTD., Yongin-si (KR)

(72) Inventors: Kihyun Pyun, Gwangmyeong-si (KR); Jang-Mi Lee, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/876,490

(22) Filed: Jul. 28, 2022

(65) Prior Publication Data

US 2023/0030280 A1 Feb. 2, 2023

(30) Foreign Application Priority Data

Jul. 29, 2021 (KR) ..... 10-2021-0100091

(51) Int. Cl.
*G09G 3/20* (2006.01)

(52) U.S. Cl.
CPC ... *G09G 3/2007* (2013.01); *G09G 2300/0819* (2013.01); *G09G 2300/0842* (2013.01); *G09G 2310/027* (2013.01); *G09G 2310/08* (2013.01); *G09G 2320/0276* (2013.01); *G09G 2330/028* (2013.01)

(58) Field of Classification Search
None
See application file for complete search history.

(56) References Cited

U.S. PATENT DOCUMENTS

| | | | | |
|---|---|---|---|---|
| 10,565,927 | B2 | 2/2020 | Suk et al. | |
| 2007/0103551 | A1 | 5/2007 | Kim et al. | |
| 2007/0200957 | A1 | 8/2007 | Sim | |
| 2010/0097307 | A1* | 4/2010 | Chen | G09G 3/3611 345/89 |
| 2011/0205439 | A1* | 8/2011 | Iisaka | G09G 3/3648 348/E5.077 |
| 2015/0035866 | A1* | 2/2015 | Ahn | G09G 3/3648 345/690 |
| 2016/0307490 | A1 | 10/2016 | Lee et al. | |

FOREIGN PATENT DOCUMENTS

| | | |
|---|---|---|
| KR | 10-0731358 | 6/2007 |
| KR | 10-0771867 | 11/2007 |
| KR | 10-2016-0123452 | 10/2016 |
| KR | 10-2018-0071467 | 6/2018 |

* cited by examiner

*Primary Examiner* — Matthew Yeung
(74) *Attorney, Agent, or Firm* — H.C. Park & Associates, PLC

(57) ABSTRACT

A controller to drive a display includes a voltage code generator and a voltage code compensator. The voltage code generator is configured to generate a first voltage code to drive pixels in the display based on input image data. The voltage code compensator is to generate a second voltage code to drive the pixels by compensating zero-grayscale codes of the first voltage code based on the zero-grayscale codes of the first voltage code, one-grayscale codes of the first voltage code, and the input image data.

16 Claims, 7 Drawing Sheets

DRIVING CONTROLLER, DISPLAY APPARATUS HAVING THE SAME AND METHOD OF DRIVING DISPLAY PANEL USING THE SAME

CROSS REFERENCE TO RELATED APPLICATION

This application claims priority from and the benefit of Korean Patent Application No. 10-2021-0100091, filed on Jul. 29, 2021, which is hereby incorporated by reference for all purposes as if fully set forth herein.

BACKGROUND

Field

Embodiments of the invention relate generally to a driving controller, a display apparatus including the driving controller and a method of driving a display panel of the display apparatus by using the driving controller. More particularly, embodiments of the invention relate to a driving controller capable of preventing a luminance overshoot that occurs when a grayscale level is changed from a black grayscale level to a specific grayscale level, a display apparatus including the driving controller and a method of driving a display panel of the display apparatus using the driving controller.

Discussion of the Background

Generally, a display apparatus includes a display panel and a display panel driver. The display panel displays an image based on input image data. The display panel includes a plurality of gate lines, a plurality of data lines and a plurality of pixels. The display panel driver includes a gate driver, a data driver and a driving controller. The gate driver outputs gate signals to the gate lines. The data driver outputs data voltages to the data lines. The driving controller controls the gate driver and the data driver.

When a grayscale level is changed from a black grayscale level to a specific grayscale level, a luminance overshoot, in which a luminance higher than a desired luminance is displayed, may occur. When a black pattern moves in a specific direction in the display panel, the luminance overshoot may be recognized as an image drag. The display quality of the display panel may be deteriorated due to the luminance overshoot and the image drag.

The above information disclosed in this Background section is only for understanding of the background of the inventive concepts, and, therefore, it may contain information that does not constitute prior art.

SUMMARY

Display apparatuses including a driving controller constructed according to the principles and illustrative embodiments of the invention are capable of preventing a luminance overshoot when a grayscale level is changed from a black grayscale level to a specific grayscale level, e.g., by compensating input image data according to a ratio of the black grayscale level of frame data of the input image data.

Methods of driving a display panel by using the driving controller according to the principles and illustrative embodiments of the invention are capable of preventing luminance overshoot when the grayscale level is changed from the black grayscale level to the specific grayscale level, e.g., by compensating the input image data according to the ratio of the black grayscale level of the frame data of the input image data.

Additional features of the inventive concepts will be set forth in the description which follows, and in part will be apparent from the description, or may be learned by practice of the inventive concepts.

According to a first aspect of the invention, a controller to drive a display includes: a voltage code generator to generate a first voltage code to drive pixels in the display based on input image data; and a voltage code compensator to generate a second voltage code to drive the pixels by compensating zero-grayscale codes of the first voltage code based on the zero-grayscale codes of the first voltage code, one-grayscale codes of the first voltage code, and the input image data.

The voltage code compensator may include a one-grayscale code extractor to extract the one-grayscale codes of the first voltage code.

The voltage code compensator may further include a compensation range operator to generate range codes based on differences between the zero-grayscale codes of the first voltage code and the one-grayscale codes of the first voltage code.

The zero-grayscale codes of the first voltage code may be substantially the same as each other, wherein the one-gray scale codes of the first voltage code of at least two of the pixels may be different from each other.

The voltage code compensator may further include a histogram analyzer to generate a grayscale histogram based on grayscale levels of frame data of the input image data.

The voltage code compensator may further include a compensation ratio operator to determine a compensation ratio of the frame data based on a ratio of grayscale levels of the grayscale histogram.

The range codes may include compensation range codes, and the voltage code compensator may further include a zero-grayscale code operator to compensate the zero-grayscale codes by multiplying the compensation range codes by the compensation ratio.

The compensation ratio operator may generate the compensation ratio when a ratio of a black grayscale level of the grayscale histogram is greater than a first threshold value and equal to or less than a second threshold value.

The compensation ratio may increase as the ratio of the black grayscale level of the grayscale histogram increases from the first threshold value to the second threshold value, and wherein the compensation ratio may have a maximum value when the ratio of the black grayscale level of the grayscale histogram is the second threshold value.

The compensation ratio operator may generate the compensation ratio when a ratio of a black grayscale level of the grayscale histogram is greater than a first threshold value.

The compensation ratio may increase as the ratio of the black grayscale level of the grayscale histogram increase from the first threshold value to 100%, and wherein the compensation ratio may have a maximum value when the ratio of the black grayscale level of the grayscale histogram is 100%.

The compensation ratio operator may generate the compensation ratio when a ratio of the grayscale histogram which is equal to or less than a reference grayscale level is greater than a third threshold value.

The compensation ratio may increase as a ratio of grayscale levels equal to or less than the reference grayscale level in the grayscale histogram increases from the third threshold value to 100%, and wherein the compensation ratio may have a maximum value when the ratio of the grayscale levels equal to or less than the reference grayscale level in the grayscale histogram is 100%.

The compensation ratio operator may generate a first compensation ratio when a ratio of a black grayscale level of the grayscale histogram is greater than a first threshold value and equal to or less than a second threshold value, and may generate a second compensation ratio when a ratio of grayscale levels equal to or less than a reference grayscale level in the grayscale histogram is greater than a third threshold value.

The compensation ratio operator may generate a first compensation ratio when a ratio of a black grayscale level of the grayscale histogram is greater than a first threshold value, and may generate a second compensation ratio when a ratio of grayscale levels equal to or less than a reference grayscale level in the grayscale histogram is greater than a third threshold value.

According to another aspect of the invention, a display apparatus includes: a controller to generate a second voltage code to drive pixels in the display apparatus by compensating zero-grayscale codes of a first voltage code based on the zero-grayscale codes of the first voltage code, one-gray scale codes of the first voltage code, and input image data; a data driver to generate a data voltage by using the second voltage code; and a display panel to display an image based on the data voltage.

The controller may include: a voltage code generator to generate the first voltage code based on the input image data; and a voltage code compensator to generate the second voltage code by compensating the zero-grayscale codes of the first voltage code based on the zero-grayscale codes of the first voltage code, the one-grayscale codes of the first voltage code, and the input image data.

The voltage code compensator may include: a one-grayscale code extractor to extract the one-grayscale codes of the first voltage code; a compensation range operator to determine range codes based on differences between the zero-grayscale codes of the first voltage code and the one-grayscale codes of the first voltage code; a histogram analyzer to generate a grayscale histogram based on grayscale levels of frame data of the input image data; a compensation ratio operator to determine a compensation ratio of the frame data based on a ratio of grayscale levels of the grayscale histogram; and a zero-grayscale code operator to compensate the zero-grayscale codes by multiplying the range codes by the compensation ratio.

According to another aspect of the invention, a method of driving a display panel includes the steps of: generating a first voltage code to drive pixels in the display panel based on input image data; generating a second voltage code to drive the pixels by compensating zero-grayscale codes of the first voltage code based on the zero-grayscale codes of the first voltage code, one-grayscale codes of the first voltage code, and the input image data; and generating a data voltage by using the second voltage code.

The step of generating the second voltage code may include: extracting the one-grayscale codes of the first voltage code of pixels; determining range codes based on differences between the zero-grayscale codes of the first voltage code and the one-grayscale codes of the first voltage code; generating a grayscale histogram based on grayscale levels of frame data of the input image data; determining a compensation ratio of the frame data based on a ratio of grayscale levels of the grayscale histogram; and compensating the zero-grayscale codes of the first voltage code by multiplying the range codes by the compensation ratio.

The data voltage may be generated using the second voltage code so that the luminance overshoot, in which a luminance higher than a desired luminance is displayed in a first frame when a grayscale level is changed from a black grayscale level to a specific grayscale level, may be prevented. Thus, the display quality of the display panel may be enhanced.

It is to be understood that both the foregoing general description and the following detailed description are illustrative and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

DETAILED DESCRIPTION

Figure 1:
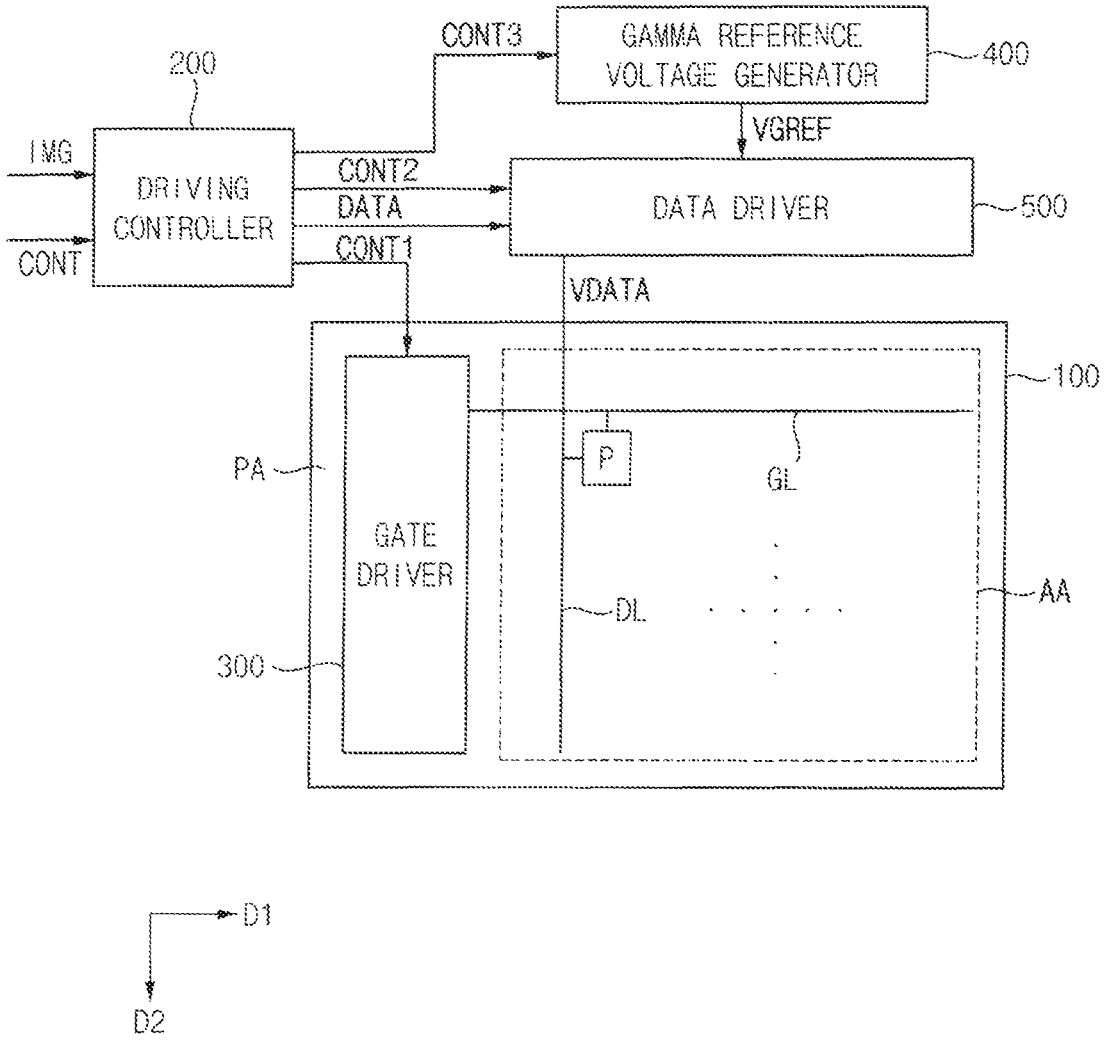
FIG. 1 is a block diagram of an embodiment of a display apparatus constructed according to the principles of the invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, wellknown structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram of an embodiment of a display apparatus constructed according to the principles of the invention.

Referring to FIG. 1, the display apparatus may include a display panel 100 and a display panel driver. The display panel driver may include a driving controller 200, a gate driver 300, a gamma reference voltage generator 400, and a data driver 500.

For example, the driving controller 200 and the data driver 500 may be integrally formed together. For example, the driving controller 200, the gamma reference voltage generator 400 and the data driver 500 may be integrally formed together. When a driving module is formed by integrating at least the driving controller 200 and the data driver 500, the driving module may be referred to as a timing controller embedded data driver (TED).

The display panel 100 may have a display region AA, on which an image is displayed, and a peripheral region PA adjacent to the display region AA.

The display panel 100 may include a plurality of gate lines GL, a plurality of data lines DL and a plurality of pixels connected to the gate lines GL and the data lines DL. The gate lines GL may extend in a first direction D1, and the data lines DL may extend in a second direction D2 crossing the first direction D1.

The driving controller 200 may receive input image data IMG and an input control signal CONT from an external apparatus. The input image data IMG may include red image data, green image data and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 may generate a first control signal CONT1, a second control signal CONT2, a third control signal CONT3 and a data signal DATA based on the input image data IMG and the input control signal CONT.

The driving controller 200 may generate the first control signal CONT1 for controlling an operation of the gate driver 300 based on the input control signal CONT, and may output the first control signal CONT1 to the gate driver 300. The first control signal CONT1 may further include a vertical start signal and a gate clock signal.

The driving controller 200 may generate the second control signal CONT2 for controlling an operation of the data driver 500 based on the input control signal CONT, and may output the second control signal CONT2 to the data driver 500. The second control signal CONT2 may include a horizontal start signal and a load signal.

The driving controller 200 may generate the data signal DATA based on the input image data IMG. The driving controller 200 may output the data signal DATA to the data driver 500.

The driving controller 200 may generate the third control signal CONT3 for controlling an operation of the gamma reference voltage generator 400 based on the input control signal CONT, and may output the third control signal CONT3 to the gamma reference voltage generator 400.

The structure and operation of an embodiment of the driving controller 200 are explained referring to FIGS. 6 to 8-12 in detail.

The gate driver 300 may generate gate signals for driving the gate lines GL in response to the first control signal CONT1 received from the driving controller 200. The gate driver 300 may output the gate signals to the gate lines GL. For example, the gate driver 300 may sequentially output the gate signals to the gate lines GL. For example, the gate driver 300 may be mounted on the peripheral region PA of the display panel 100. For example, the gate driver 300 may be integrated on the peripheral region PA of the display panel 100.

The gamma reference voltage generator 400 may generate a gamma reference voltage VGREF in response to the third control signal CONT3 received from the driving controller 200. The gamma reference voltage generator 400 may provide the gamma reference voltage VGREF to the data driver 500. The gamma reference voltage VGREF may have a value corresponding to a level of the data signal DATA.

In an embodiment, the gamma reference voltage generator 400 may be integrated with the driving controller 200, or with the data driver 500.

The data driver 500 may receive the second control signal CONT2 and the data signal DATA from the driving controller 200, and may receive the gamma reference voltages VGREF from the gamma reference voltage generator 400. The data driver 500 may convert the data signal DATA into data voltages VDATA as analog signals by using the gamma reference voltages VGREF. The data driver 500 may output the data voltages VDATA to the data lines DL. For example, the data driver 500 may be mounted on the peripheral region PA of the display panel 100. For example, the data driver 500 may be integrated on the peripheral region PA of the display panel 100.

Figure 2:
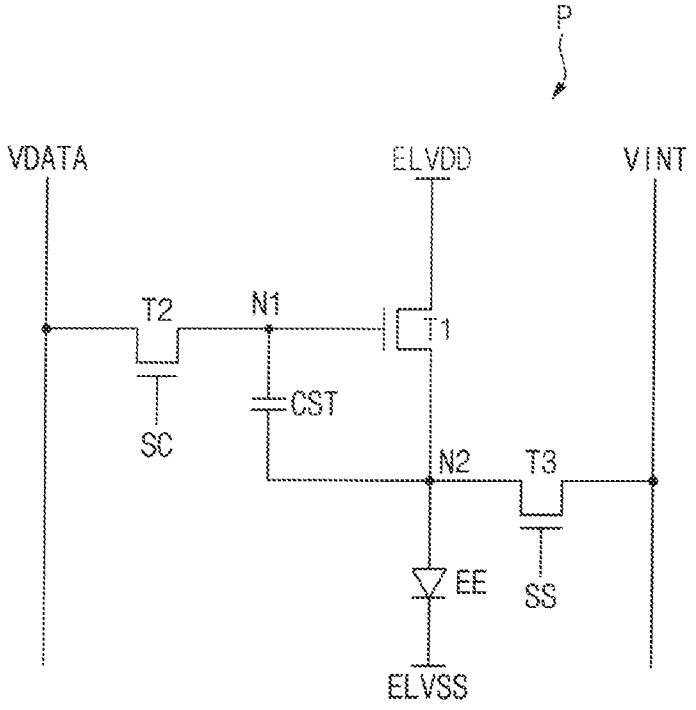
FIG. 2 is a circuit diagram of a representative pixel of the display apparatus of FIG. 1.

FIG. 2 is a circuit diagram of a representative pixel P of the display apparatus of FIG. 1.

Referring to FIGS. 1 and 2, for example, the pixel P may include a first switching element T1, a second switching element T2 and an emitting element EE. For example, the pixel P may further include a storage capacitor CST and a third switching element T3.

The first switching element T1 may include a control electrode connected to a first node N1, an input electrode for receiving a first power voltage ELVDD and an output electrode connected to a second node N2.

The second switching element T2 may include a control electrode for receiving a first gate signal SC, an input electrode for receiving the data voltage VDATA and an output electrode connected to the first node N1.

The emitting element EE may include a first electrode connected to the second node N2 and a second electrode for receiving a second power voltage ELVSS. The second power voltage ELVSS may be less than the first power voltage ELVDD.

The storage capacitor CST may include a first electrode connected to the first node N1 and a second electrode connected to the second node N2.

The third switching element T3 may include a control electrode receiving a second gate signal SS, an input electrode receiving an initialization voltage VINT and an output electrode connected to the second node N2.

For example, the first switching element T1, the second switching element T2 and the third switching element T3 may be N-type transistors. For example, the first switching element T1, the second switching element T2 and the third switching element T3 may be oxide transistors.

For example, the control electrodes of the first switching element T1, the second switching element T2 and the third switching element T3 may be gate electrodes. For example, the input electrodes of the first switching element T1, the second switching element T2 and the third switching element T3 may be source electrodes. For example, the output electrodes of the first switching element T1, the second switching element T2 and the third switching element T3 may be drain electrodes.

Figure 3:
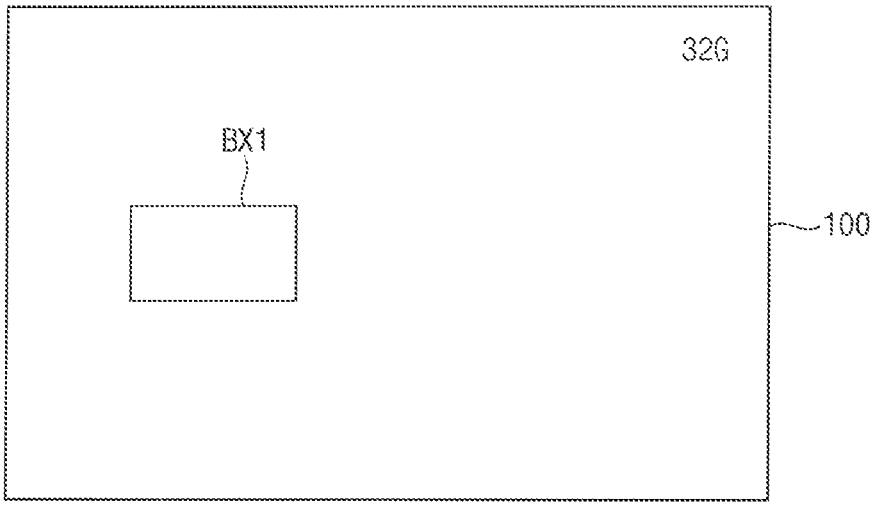
FIG. 3 is a schematic view of a display panel of the display apparatus of FIG. 1 displaying a first image in a first frame.
Figure 4:
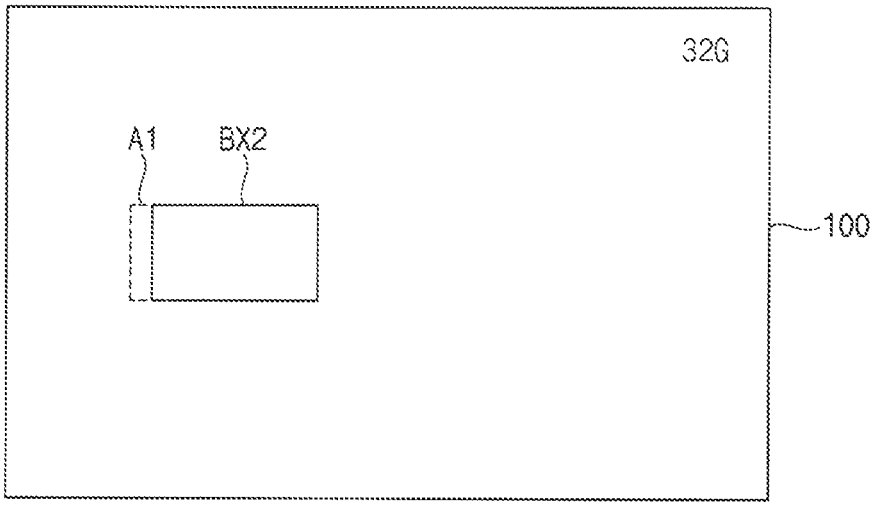
FIG. 4 is a schematic view of the display panel of the display apparatus of FIG. 1 displaying a second image in a second frame.
Figure 5:
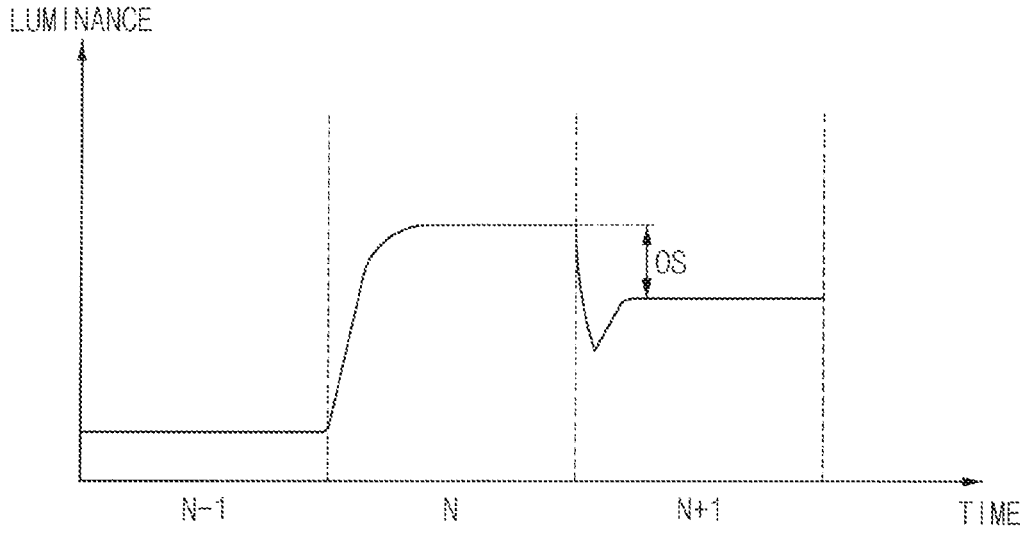
FIG. 5 is a waveform diagram illustrating a luminance of a pixel according to a grayscale level of a pixel in an (N−1)-th frame, an N-th frame and an (N+1)-th frame.

FIG. 3 is a schematic view of a display panel 100 of the display apparatus of FIG. 1 displaying a first image in a first frame. FIG. 4 is a schematic view of the display panel 100 of the display apparatus of FIG. 1 displaying a second image in a second frame. FIG. 5 is a waveform diagram illustrating a luminance of a pixel according to a grayscale level of a pixel in an (N−1)-th frame, an N-th frame and an (N+1)-th frame.

For example, in FIG. 3, a background portion of the display panel 100 may display an image of a 32 grayscale level (32 G) and a left central portion of the display panel 100 may display a first black pattern BX1 (e.g., a zero grayscale level (0 G)).

For example, in FIG. 4, a background portion of the display panel 100 may display an image of a 32 grayscale level 32 G and a left central portion of the display panel 100 may display a second black pattern BX2 (e.g., a zero grayscale level (0 G)). The second black pattern BX2 of FIG. 4 may be slightly shifted in a right direction compared to the first black pattern BX1 of FIG. 3.

An area A1 of FIG. 4 may be an area in which the first black pattern BX1 is displayed in the first frame as shown in FIG. 3 and an image of a 32 grayscale level is displayed in the second frame as shown in FIG. 4.

As the area A1 displays a black image in the first frame and the image of a 32 grayscale level in the second frame, the area A1 may be brighter than other background portions having a 32 grayscale level in FIG. 4 due to the luminance overshoot. The area A1 may be apparent to a user as an image drag due to the luminance overshoot.

The reason why the luminance overshoot occurs is explained in detail referring to FIG. 5. In FIG. 5, for example, a specific pixel may have a zero grayscale level (e.g., a black grayscale level) in the (N−1)-th frame, a 32 grayscale level in the N-th frame, and a 32 grayscale level in the (N+1)-th frame.

For example, after the pixel displays an image of a zero grayscale level in the (N−1)-th frame, a voltage of the second node N2 of the pixel may have a voltage less than about 10V corresponding to a zero grayscale level in a floating state.

For example, the second node N2 of the pixel may be initialized to the initialization voltage VINT in the N-th frame. Herein, the initialization voltage VINT may have a value of about 2.0V. When the initialization voltage VINT is charged to the second node N2 of the pixel in the N-th frame, the voltage of the second node N2 of the pixel may be discharged to 2.0V from the voltage of less than about 10V. Thus, the voltage difference of the second node N2 of the pixel between the (N−1)-th frame and the N-th frame at the initialization time of the N-th frame may be less than about 8V.

For example, after the pixel displays an image of a 32 grayscale level in the N-th frame, the voltage of the second node N2 of the pixel may have about 12V corresponding to a 32 grayscale level in a floating state.

For example, the second node N2 of the pixel may be initialized to the initialization voltage VINT in the (N+1)-th frame. Herein, the initialization voltage VINT may have a value of about 2.0V. When the initialization voltage VINT is charged to the second node N2 of the pixel in the (N+1)-th frame, the second node N2 of the pixel may be charged to about 2.0V from the voltage of 12V so that the voltage difference of the second node N2 of the pixel between the N-th frame and the (N+1)-th frame at the initialization time of the (N+1)-th frame may be about 10V.

The voltage difference of the second node N2 of the pixel between the (N−1)-th frame and the N-th frame at the initialization time is less than the voltage difference of the second node N2 of the pixel between the N-th frame and the (N+1)-th frame at the initialization time. Thus, the charging rate (or charging amount) of the initialization voltage VINT at the initialization time of the (N+1)-th frame may be greater than the discharging rate (or discharging amount) of the initialization voltage VINT at the initialization time of the N-th frame.

When the charging rate of the initialization voltage VINT at the initialization time of the (N+1)-th frame is greater than the discharging rate of the initialization voltage VINT at the initialization time of the N-th frame, the luminance of the image in the N-th frame may be higher than the luminance of the image in the (N+1)-th frame when the N-th frame and the (N+1)-th frame have the same grayscale level (e.g., a 32 grayscale level). For example, the difference between the charging rate and the discharging rate (or the charging amount and the discharging amount) at the initialization times of the N-th frame and the (N+1)-th frame may cause the difference between the settling times of the voltage of the second node N2 of the pixel at the initialization times of the N-th frame and the (N+1)-th frame. The settling time difference of the voltage of the second node N2 of the pixel at the initialization times of the N-th frame and the (N+1)-th frame may cause the luminance difference between the N-th frame and the (N+1)-th frame.

In FIG. 5, the difference between the luminance of the image in a steady state of the N-th frame and the luminance of the image in the steady state of the (N+1)-th frame may be defined as the luminance overshoot OS.

When the N-th frame and the (N+1)-th frame have the same grayscale level (e.g., 32 grayscale level), it is not preferable that the luminance of the image of the N-th frame be higher than the luminance of the image of the (N+1)-th frame. When the black pattern moves (e.g., from the first black pattern BX1 to the second black pattern BX2) as shown in FIGS. 3 and 4, the luminance difference may be shown as the image drag (in the area A1 in FIG. 4).

Figure 6:
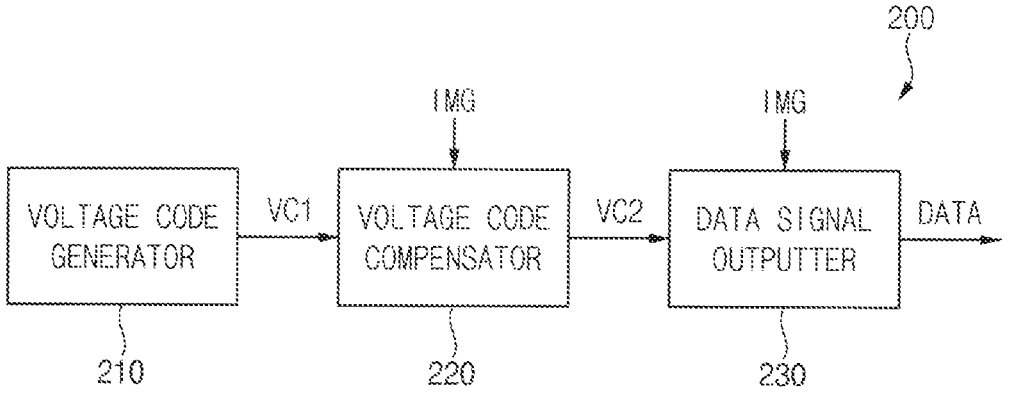
FIG. 6 is a block diagram of an embodiment of a driving controller of the display apparatus of FIG. 1.
Figure 7:
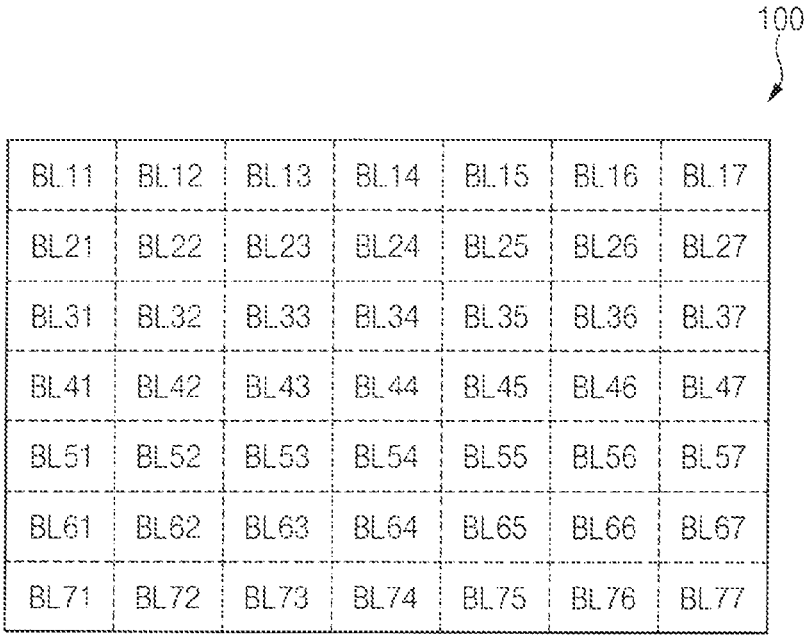
FIG. 7 is a schematic view of a plurality of display blocks of the display panel of FIG. 1.

FIG. 6 is a block diagram of an embodiment of a driving controller 200 of the display apparatus of FIG. 1. FIG. 7 is a schematic view of a plurality of display blocks of the display panel 100 of FIG. 1.

Referring to FIGS. 1 to 7, the driving controller 200 may include a voltage code generator 210 and a voltage code compensator 220. The driving controller 200 may further include a data signal outputter 230.

The voltage code generator 210 may generate a first voltage code VC1 representing the data voltage VDATA corresponding to the input image data IMG. For example, the voltage code generator 210 may generate the first voltage code VC1 based on the input image data IMG. For example, the first voltage code VC1 may include voltage information of the input image data IMG corresponding to the data voltage VDATA. For example, the first voltage code VC1 may include voltage levels corresponding to grayscale levels of the pixels.

For example, the voltage code generator 210 may divide the display panel 100 into a plurality of display blocks (e.g., BL11 to BL77 in FIG. 7) and may generate the first voltage code VC1 for compensating non-uniformity of luminance and non-uniformity of color coordinates between the display blocks.

For example, the first voltage code VC1 may include voltage codes according to grayscale levels for all pixels of the display panel 100.

In FIG. 7, for example, the display panel 100 may be divided into display blocks BL11 to BL77 in seven rows and seven columns. For example, one target luminance and one target color coordinates may be set to prevent or minimize the non-uniformity of luminance and the non-uniformity of color coordinates between the display blocks BL11 to BL77.

For example, the target luminance and the target color coordinates may be a luminance and color coordinates of a central display block (e.g., BL44) corresponding to a central portion of the display panel 100. The first voltage code VC1 may be generated. Thus, the luminances and the color coordinates of the display blocks other than the central display block (e.g., BL44) may be the same as the luminance and the color coordinates of the central display block (e.g., BL44).

For example, the first voltage code VC1 may be generated by using measured values of the luminances of the display blocks BL11 to BL77, which are measured by a luminance meter. For example, the first voltage code VC1 may be stored in a lookup table type.

The luminance meter may measure the values in a unit of the display block and the first voltage code VC1 may be generated in a unit of the pixel. For example, the luminance meter may measure the value of the luminance corresponding to each of the display blocks BL11 to BL77, and the first voltage code VC1 of each pixel may be generated by using the measured value of the luminance corresponding to each of the display blocks BL11 to BL77. To generate the first voltage code VC1 in the unit of the pixel, the measured values in the unit of the display block may be interpolated.

Figure 8:
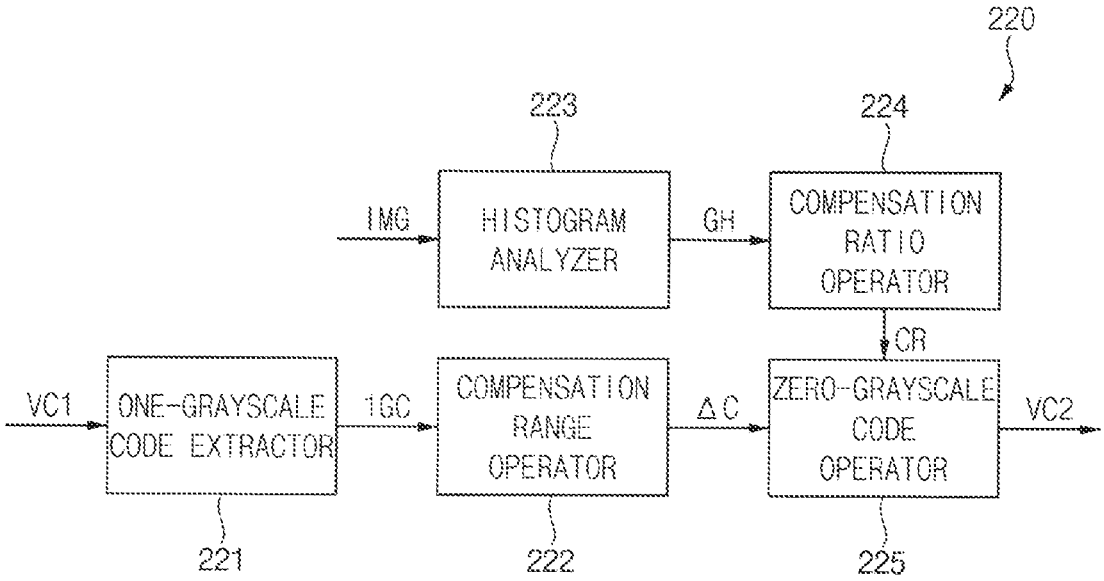
FIG. 8 is a block diagram of an embodiment of a voltage code compensator of the driving controller of FIG. 6.
Figure 9:
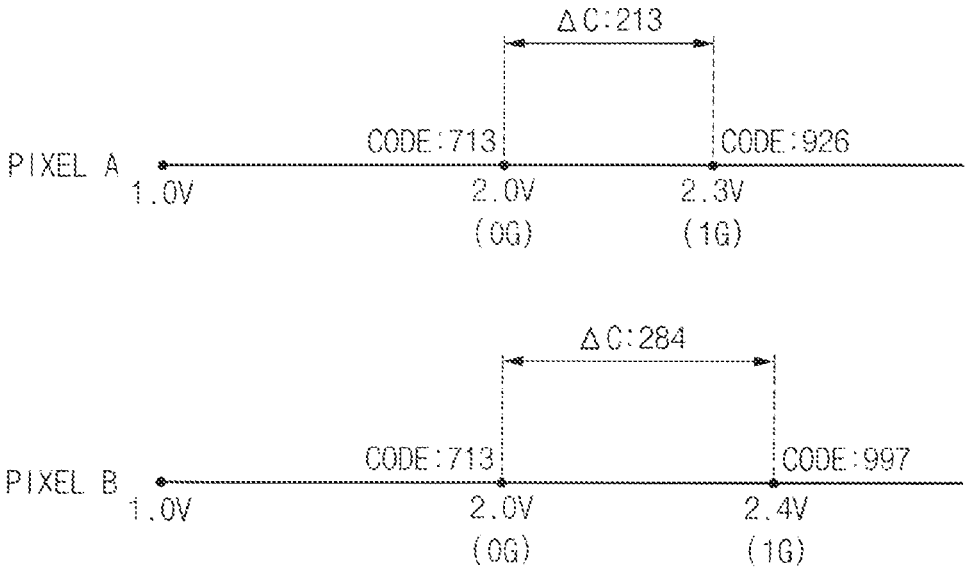
FIG. 9 is a schematic diagram illustrating an operation of a compensation range operator of the voltage code compensator of FIG. 8.
Figure 10:
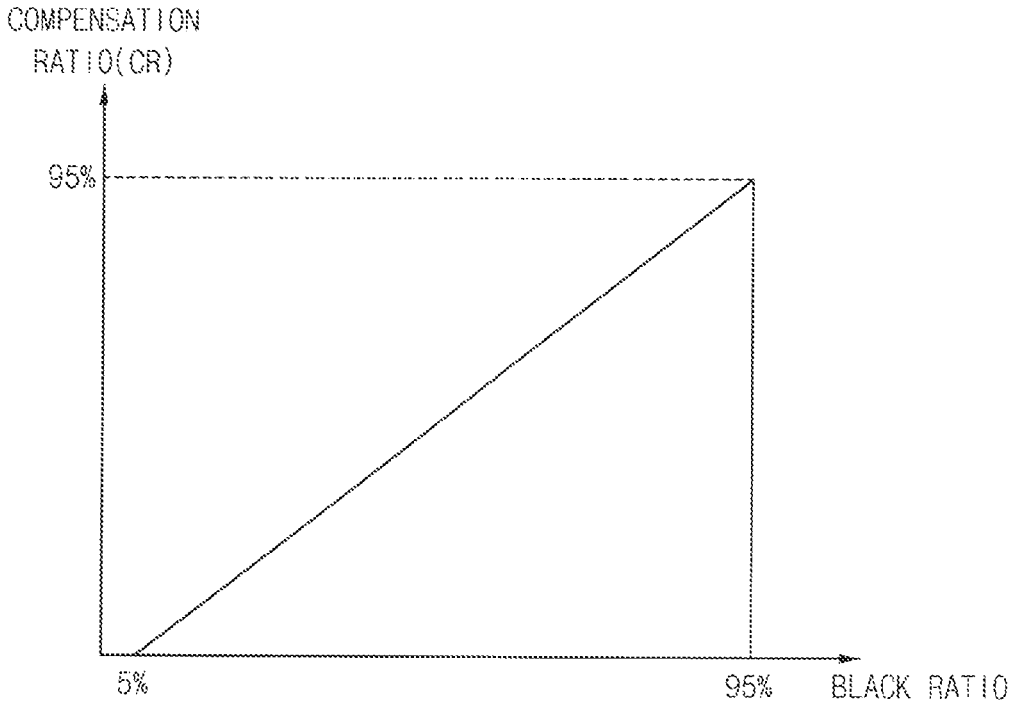
FIG. 10 is a graph illustrating an embodiment of an operational method of a compensation ratio operator of the voltage code compensator of FIG. 8 according to the principles of the invention.

FIG. 8 is a block diagram of an embodiment of a voltage code compensator of the driving controller of FIG. 6. FIG. 9 is a schematic diagram illustrating an operation of a compensation range operator 222 of the voltage code compensator 220 of FIG. 8. FIG. 10 is a graph illustrating an embodiment of an operational method of a compensation ratio operator 224 of the voltage code compensator 220 of FIG. 8 according to the principles of the invention.

Referring to FIGS. 1 to 10, the voltage code compensator 220 may receive the first voltage code VC1. The voltage code compensator 220 may compensate a zero-grayscale code among the first voltage code VC1 to generate a second voltage code VC2. The zero-grayscale code of the first voltage code VC1 may be different from a zero-grayscale code of the second voltage code VC2. In contrast, all grayscale codes of the first voltage code VC1 except for the zero-grayscale code of the first voltage code VC1 may be respectively the same as all grayscale codes of the second voltage code VC2 except for the zero-grayscale code of the second voltage code VC2.

When the display panel 100 displays an image based on 256 grayscale levels, the first voltage code VC1 may have grayscale codes corresponding to a zero grayscale level to a 255 grayscale level and the second voltage code VC2 may have grayscale codes corresponding to a zero grayscale level to a 255 grayscale level.

The voltage code compensator 220 may generate the second voltage code VC2 based on the zero-grayscale code of the first voltage code VC1, a one-grayscale code of the first voltage code VC1 and the input image data IMG. For example, the second voltage code VC2 may have the compensated zero-grayscale code of the first voltage code VC1.

The data signal outputter 230 may receive the second voltage code VC2 from the voltage code compensator 220. The data signal outputter 230 may output the data signal DATA corresponding to the input image data IMG based on the second voltage code VC2.

For example, the driving controller 200 may be integrally formed with the data driver 500. When the driving controller 200 is integrally formed with the data driver 500, the data signal outputter 230 may be integrally formed with the data driver 500. Herein, the data driver 500 may generate the data voltage VDATA corresponding to the input image data IMG based on the second voltage code VC2, and then may output the data voltage VDATA to the display panel 100.

For example, the voltage code compensator 220 may include a one-grayscale code extractor 221, a compensation range operator 222, a histogram analyzer 223, a compensation ratio operator 224 and a zero-grayscale code operator 225.

The one-grayscale code extractor 221 may extract one-grayscale codes (1 GC) of the first voltage code VC1 of the pixels.

The compensation range operator 222 may generate range codes, which may be in the form of compensation range codes of the pixels, based on differences between the zero-grayscale codes of the first voltage code VC1 of the pixels and the one-grayscale codes of the first voltage code VC1 of the pixels.

For example, the zero-grayscale codes of the first voltage code VC1 of the pixels may be same as each other. In contrast, the one-grayscale codes of the first voltage code VC1 of at least two of the pixels may be different from each other.

As shown in FIG. 9, a zero-grayscale code of a pixel A may be 713. For example, the voltage code of 713 may correspond to a voltage of about 2.0V. A zero-grayscale code of a pixel B may be also 713.

As shown in FIG. 9, a one-grayscale code of the pixel A may be 926. For example, the voltage code of 926 may correspond to a voltage of about 2.3V. Thus, the compensation code ΔC of the pixel A may be 213 which is determined by subtracting 714 from 926 (i.e., 926−713). The illustrated embodiment may be designed for reducing the luminance overshoot occur when a grayscale level is changed from a black grayscale level to a specific grayscale level. To reduce the luminance overshoot, the zero-grayscale code corresponding to the black grayscale level may be set to relatively high value. Herein, the compensation range code ΔC may mean a range in which the zero-grayscale code can be increased.

For example, when the zero-grayscale code of the pixel A is not compensated, the zero-grayscale code of the pixel A may be 713. When the zero-grayscale code of the pixel A is compensated by 100, the zero-grayscale code of the pixel A may be 813 (i.e., 713+100). When the zero-grayscale code of the pixel A is compensated by 200, the zero-grayscale code of the pixel A may be 913 (i.e., 713+200). However, when the zero-grayscale code of the pixel A is compensated by a value greater than 213, the zero-grayscale code of the pixel A may become greater than the one-grayscale code of the pixel A so that it is not appropriate to compensate the zero-grayscale code of the pixel A by the value greater than 213.

A one-grayscale code of the pixel B may be 997. For example, the voltage code of 997 may correspond to a voltage of about 2.4V. Thus, the compensation range code ΔC of the pixel B may be 284 which is determined by subtracting 713 from 997 (i.e., 997−713).

For example, when the zero-grayscale code of the pixel B is not compensated, the zero-grayscale code of the pixel B may be 713. When the zero-grayscale code of the pixel B is compensated by 100, the zero-grayscale code of the pixel B may be 813 (i.e., 713+100). When the zero-grayscale code of the pixel B is compensated by 200, the zero-grayscale code of the pixel B may be 913 (i.e., 713+200). However, when the zero-grayscale code of the pixel B is compensated by a value greater than 284, the zero-grayscale code of the pixel B may become greater than the one-grayscale code of the pixel B so that it is not appropriate to compensate the zero-grayscale code of the pixel B by the value greater than 284.

Herein, the zero-grayscale code of the pixel A is same as the zero-grayscale code of the pixel B. The one-grayscale code of the pixel B is greater than the one-grayscale code of the pixel A. Thus, the compensation range code ΔC (e.g., 284) of the pixel B may be greater than the compensation range code ΔC (e.g., 213) of the pixel A.

The histogram analyzer 223 may receive the input image data IMG. The histogram analyzer 223 may generate a grayscale histogram (GH) based on grayscale levels of is frame data of the input image data IMG. The grayscale histogram may represent a frequency of each grayscale level of the frame data.

The compensation ratio operator 224 may generate a compensation ratio (CR) of the frame data based on a ratio of grayscale levels of the grayscale histogram.

The zero-grayscale code operator 225 may generate zero grayscale compensation values to compensate the zero-grayscale codes of the pixels by multiplying the compensation range codes ΔC of the pixels by the compensation ratio.

For example, the zero-grayscale code of the pixel A may be 713 and the compensation range code ΔC of the pixel A may be 213. When the compensation ratio determined by the compensation ratio operator 224 is 30%, the zero grayscale compensation value may be 63.9 which is 30% of 213. Herein, the zero-grayscale code of the pixel A may be compensated to 776.9 by adding 63.9 to 713. Alternatively, the zero-grayscale code of the pixel A may be compensated to 777 which is the closest integer to 776.9.

When the compensation ratio determined by the compensation ratio operator 224 is 60%, the zero grayscale compensation value may be 127.8 which is 60% of 213. Herein, the zero-grayscale code of the pixel A may be compensated to 840.8 by adding 127.8 to 713. Alternatively, the zero-grayscale code of the pixel A may be compensated to 841 which is the closest integer to 840.8.

As shown in FIG. 10, the compensation ratio operator 224 may generate the compensation ratio when a ratio (e.g., percentage) of a black grayscale level of the grayscale histogram is greater than a first threshold value and equal to or less than a second threshold value. The ratio of the black grayscale level of the grayscale histogram may be referred as to a black ratio. For example, the first threshold value may be 5% and the second threshold value is may be 95%.

When the ratio of the black grayscale level which may cause the luminance overshoot is equal to or less than 5%, the luminance overshoot may not be well recognized by the user so that the compensation of the zero-grayscale code may not be necessary.

When the ratio of the black grayscale level is greater than 95%, the ratio of the black portion in the image is very high so that the luminance overshoot may not be well recognized by the user.

Except for the extreme cases (e.g., when the black ratio is greater than the first threshold value and equal to or less than the second threshold value), as the ratio of the black grayscale level, which causes the luminance overshoot, increases, the compensation ratio may increase.

As the black ratio (i.e., the ratio of the black grayscale level of the grayscale histogram) increases from the first threshold value (e.g., 5%) to the second threshold value (e.g., 95%), the compensation ratio may increase. When the black ratio is the second threshold value (e.g., 95%), the compensation ratio may be a maximum compensation ratio. For example, the maximum compensation ratio may be 95%. When the compensation ratio is 100%, the zero-grayscale code may be compensated to be same as the one-grayscale code. When the zero-grayscale code is same as the one-grayscale code, a resolution of image display decreases so that it may be undesirable in terms of an image quality.

According to an embodiment, the second voltage code VC2 for compensating the zero-grayscale code of the first voltage code VC1 may be generated based on the zero-grayscale code of the first voltage code VC1, the one-grayscale code of the first voltage code VC1 and the input image data IMG.

The data voltage VDATA may be generated by using the second voltage code VC2 so that the luminance overshoot, in which a luminance higher than a desired luminance is displayed in a first frame when a grayscale level is changed from a black grayscale level to a specific grayscale level, may be prevented. Thus, the display quality of the display panel 100 may be enhanced or improved.

Figure 11:
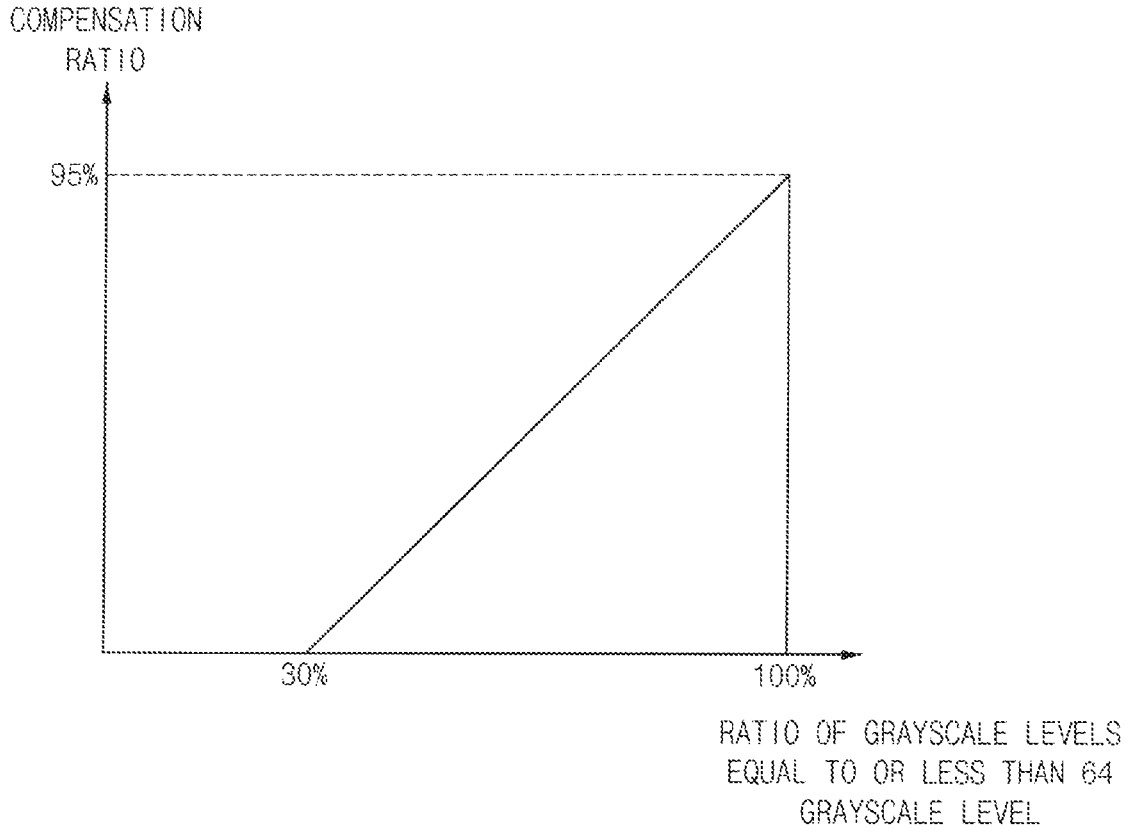
FIG. 11 is a graph illustrating another embodiment of the operation of the compensation ratio operator of the voltage code compensator of FIG. 8 according to the principles of the invention.

FIG. 11 is a graph illustrating another embodiment of the operation of the compensation ratio operator 224 of the voltage code compensator 220 of FIG. 8 according to the principles of the invention.

The driving controller, the display apparatus and the method of driving the display panel according to this embodiment is substantially the same as the driving controller, the display apparatus and the method of driving the display panel of the previous embodiment explained referring to FIGS. 1 to 10 except for the operation of the compensation ratio operator. Thus, the same reference numerals will be used to refer to the same or like parts as those described in the previous embodiment of FIGS. 1 to 10 and any redundant explanation concerning the above elements will be omitted for descriptive convenience.

Referring to FIGS. 1 to 9 and 11, the display apparatus may include a display panel 100 and a display panel driver. The display panel driver may include a driving controller 200, a gate driver 300, a gamma reference voltage generator 400 and a data driver 500.

The driving controller 200 may include a voltage code generator 210 and a voltage code compensator 220. The driving controller 200 may further include a data signal outputter 230.

The voltage code compensator 220 may receive the first voltage code VC1. The voltage code compensator 220 may compensate a zero-grayscale code among the first voltage code VC1 to generate a second voltage code VC2.

The voltage code compensator 220 may generate the second voltage code VC2, which has the compensated zero-grayscale code of the first voltage code VC1, based on the zero-grayscale code of the first voltage code VC1, a one-grayscale code of the first voltage code VC1 and the input image data IMG.

For example, the voltage code compensator 220 may include a one-grayscale code extractor 221, a compensation range operator 222, a histogram analyzer 223, a compensation ratio operator 224 and a zero-grayscale code operator 225.

The compensation ratio operator 224 may determine a compensation ratio of the frame data based on a ratio of grayscale levels of the grayscale histogram.

The zero-grayscale code operator 225 may generate zero grayscale compensation values to compensate the zero-grayscale codes of the pixels by multiplying the compensation range codes ΔC of the pixels by the compensation ratio.

As shown in FIG. 11, the compensation ratio operator 224 may generate the compensation ratio when a ratio (e.g., percentage) of grayscale levels equal to or less than a reference grayscale level in the grayscale histogram is greater than a third threshold value. For example, the reference grayscale level may be 64 grayscale level (64 G), and the third threshold value may be 30%.

When the luminance of the image displayed after the black image or the luminance of the background image excluding the black image is high, the luminance overshoot may not be apparent to a user. In contrast, when the luminance of the image displayed after the black image or the luminance of the background image excluding the black image is low, the luminance overshoot may be very apparent to a user.

Thus, the compensation ratio may be generated only when a ratio of the grayscale histogram which is equal to or less than the reference grayscale level (e.g., 64 grayscale level) is greater than the third threshold value.

The compensation ratio may increase as the ratio of the low grayscale image, which may cause the luminance overshoot to be well recognized, increases.

As the ratio of the grayscale levels equal to or less than the reference grayscale level in the grayscale histogram increases from the third threshold value (e.g., 30%) to 100%, the compensation ratio may increase. When the ratio of the grayscale levels equal to or less than the reference grayscale level in the grayscale histogram is 100%, the compensation ratio may be a maximum compensation ratio. In an embodiment, for example, the maximum compensation ratio may be 95%.

In FIG. 10, the compensation ratio according to the black ratio is exemplified and, in FIG. 11, the compensation ratio according to the ratio of grayscale levels equal to or less than a reference grayscale level is exemplified.

The compensation ratio operator 224 may generate a first compensation ratio when the ratio of the black grayscale level of the grayscale histogram is greater than the first threshold value and equal to or less than the second threshold value and a second compensation ratio when the ratio of the grayscale levels equal to or less than the reference grayscale level in the grayscale histogram is greater than a third threshold value by using both of the methods of FIGS. 10 and 11.

The compensation ratio operator 224 may generate a final compensation ratio by generating the first compensation ratio and the second compensation ratio. For example, the final compensation ratio may be a larger value of the first compensation ratio and the second compensation ratio. Alternatively, the final compensation ratio may be an average value of the first compensation ratio and the second compensation ratio. Alternatively, the final compensation ratio may be generated or calculated by multiplying the first compensation ratio by the second compensation ratio.

According to an embodiment, the second voltage code VC2 compensating the zero-grayscale code of the first voltage code VC1 may be generated based on the zero-grayscale code of the first voltage code VC1, the one-grayscale code of the first voltage code VC1 and the input image data IMG.

The data voltage VDATA may be generated by using the second voltage code VC2 so that the luminance overshoot, in which a luminance higher than a desired luminance is displayed in a first frame when a grayscale level is changed from a black grayscale level to a specific grayscale level, may be prevented. Thus, the display quality of the display panel 100 may be enhanced or improved.

Figure 12:
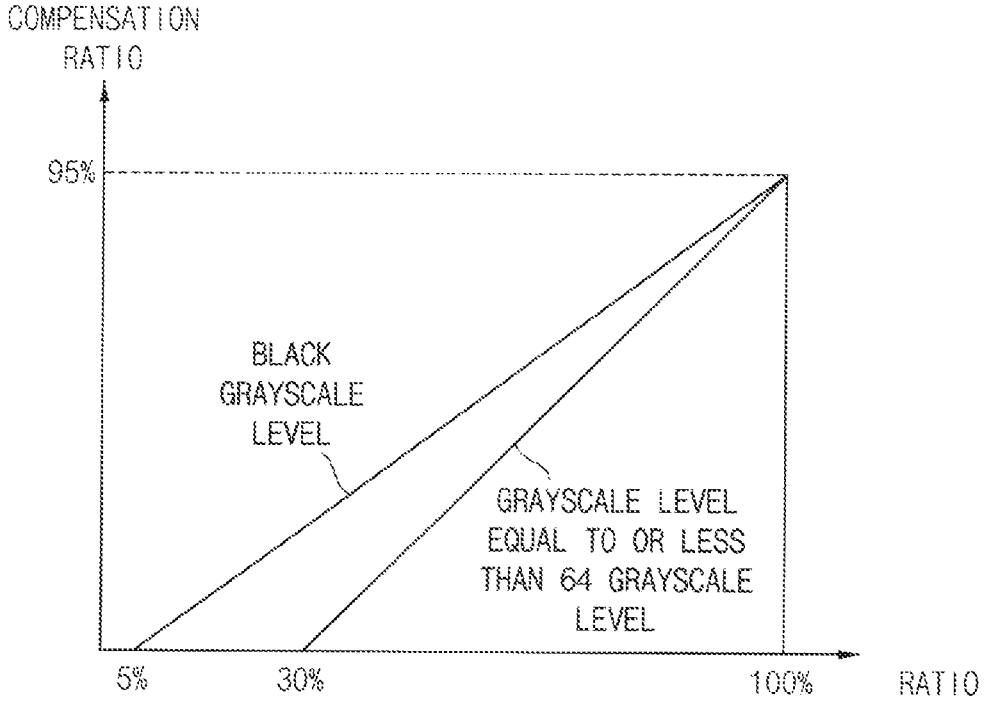
FIG. 12 is a graph illustrating of still another embodiment of the operation of the compensation ratio operator of the voltage code compensator of FIG. 8 according to the principles of the invention.

FIG. 12 is a graph illustrating of still another embodiment of the operation of the compensation ratio operator 224 of the voltage code compensator 220 of FIG. 8 according to the principles of the invention.

The driving controller, the display apparatus and the method of driving the display panel according to this embodiment is substantially the same as the driving controller, the display apparatus and the method of driving the display panel of the previous embodiment explained referring to FIGS. 1 to 10 except for the operation of the compensation ratio operator. Thus, the same reference numerals will be used to refer to the same or like parts as those described in the previous embodiment of FIGS. 1 to 10 and any duplicative explanation concerning the above elements will be omitted to avoid redundancy.

Referring to FIGS. 1 to 9 and 12, the display apparatus may include a display panel 100 and a display panel driver. The display panel driver may include a driving controller 200, a gate driver 300, a gamma reference voltage generator 400 and a data driver 500.

The driving controller 200 may include a voltage code generator 210 and a voltage code compensator 220. The driving controller 200 may further include a data signal outputter 230.

The voltage code compensator 220 may receive the first voltage code VC1. The voltage code compensator 220 may compensate a zero-grayscale code among the first voltage code VC1 to generate a second voltage code VC2.

The voltage code compensator 220 may generate the second voltage code VC2 having the compensated zero-grayscale code of the first voltage code VC1 based on the zero-grayscale code of the first voltage code VC1, a one-grayscale code of the first voltage code VC1 and the input image data IMG.

For example, the voltage code compensator 220 may include a one-grayscale code extractor 221, a compensation range operator 222, a histogram analyzer 223, a compensation ratio operator 224 and a zero-grayscale code operator 225.

The compensation ratio operator 224 may generate a compensation ratio of the frame data based on a ratio of grayscale levels of the grayscale histogram.

The zero-grayscale code operator 225 may generate zero grayscale compensation values to compensate the zero-grayscale codes of the pixels by multiplying the compensation range codes ΔC of the pixels by the compensation ratio.

As shown in FIG. 12, the compensation ratio operator 224 may generate the compensation ratio when a ratio of a black grayscale level of the grayscale histogram is greater than a first threshold value. The ratio of the black grayscale level of the grayscale histogram may be referred as to a black ratio. For example, the first threshold value may be 5%.

When the ratio of the black grayscale level which may cause the luminance overshoot is equal to or less than 5%, the luminance overshoot may not be readily apparent to the user so that the compensation of the zero-grayscale code may not be necessary.

As the black ratio increases from the first threshold value (e.g., 5%) to 100%, the compensation ratio may increase. When the black ratio is 100%, the compensation ratio may be a maximum compensation ratio. In an embodiment, for example, the maximum compensation ratio may be 95%.

In FIG. 12, the compensation according to the black ratio is exemplified and, in FIG. 11, the compensation according to the ratio of under reference grayscale level is exemplified.

The compensation ratio operator 224 may generate a first compensation ratio when the ratio of the black grayscale level of the grayscale histogram is greater than the first threshold value and a second compensation ratio when the ratio of under reference grayscale level of the grayscale histogram is greater than a third threshold value by using both of the methods of FIGS. 10 and 11.

The compensation ratio operator 224 may generate a final compensation ratio by generating the first compensation ratio and the second compensation ratio. For example, the final compensation ratio may be a larger value of the first compensation ratio and the second compensation ratio. Alternatively, the final compensation ratio may be an average value of the first compensation ratio and the second compensation ratio. Alternatively, the final compensation ratio may be generated or calculated by multiplying the first compensation ratio by the second compensation ratio.

According to an embodiment, the second voltage code VC2 compensating the zero-grayscale code of the first voltage code VC1 may be generated based on the zero-grayscale code of the first voltage code VC1, the one-grayscale code of the first voltage code VC1 and the input image data IMG.

The data voltage VDATA may be generated using the second voltage code VC2 so that the luminance overshoot, in which a luminance higher than a desired luminance is displayed in a first frame when a grayscale level is changed from a black grayscale level to a specific grayscale level, may be prevented. Thus, the display quality of the display panel 100 may be enhanced or improved.

Driving controllers constructed according to the principles and illustrative embodiments of the inventions, display apparatus including the same and methods of driving display panels using the same may reduce luminance overshoot and thereby enhance the display quality of the display panel.

Although certain embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A controller to drive a display, the controller comprising:

a voltage code generator to generate a first voltage code to drive pixels in the display based on input image data; and a voltage code compensator to generate a second voltage code to drive the pixels by compensating zero-grayscale codes of the first voltage code based on the zero-grayscale codes of the first voltage code, one-grayscale codes of the first voltage code, and the input image data, wherein the voltage code compensator comprises:

a one-grayscale code extractor to extract the one-grayscale codes of the first voltage code;

a compensation range operator to generate range codes based on differences between the zero-grayscale codes of the first voltage code and the one-grayscale codes of the first voltage code;

a histogram analyzer to generate a grayscale histogram based on grayscale levels of frame data of the input image data; and a compensation ratio operator to determine a compensation ratio of the frame data based on a ratio of grayscale levels of the grayscale histogram.

2. The controller of claim 1, wherein the zero-grayscale codes of the first voltage code are substantially the same as each other, wherein the one-grayscale codes of the first voltage code of at least two of the pixels are different from each other.

3. The controller of claim 1, wherein the range codes comprise compensation range codes, and wherein the voltage code compensator further comprises a zero-grayscale code operator to compensate the zero-grayscale codes by multiplying the compensation range codes by the compensation ratio.

4. The controller of claim 1, wherein the compensation ratio operator generates the compensation ratio when a ratio of a black grayscale level of the grayscale histogram is greater than a first threshold value and equal to or less than a second threshold value.

5. The controller of claim 4, wherein the compensation ratio increases as the ratio of the black grayscale level of the grayscale histogram increases from the first threshold value to the second threshold value, and wherein the compensation ratio has a maximum value when the ratio of the black grayscale level of the grayscale histogram is the second threshold value.

6. The controller of claim 1, wherein the compensation ratio operator generates the compensation ratio when a ratio of a black grayscale level of the grayscale histogram is greater than a first threshold value.

7. The controller of claim 6, wherein the compensation ratio increases as the ratio of the black grayscale level of the grayscale histogram increases from the first threshold value to 100%, and wherein the compensation ratio has a maximum value when the ratio of the black grayscale level of the grayscale histogram is 100%.

8. The controller of claim 1, wherein the compensation ratio operator generates the compensation ratio when a ratio of the grayscale histogram which is equal to or less than a reference grayscale level is greater than a third threshold value.

9. The controller of claim 8, wherein the compensation ratio increases as a ratio of grayscale levels equal to or less than the reference grayscale level in the grayscale histogram increases from the third threshold value to 100%, and wherein the compensation ratio has a maximum value when the ratio of the grayscale levels equal to or less than the reference grayscale level in the grayscale histogram is 100%.

10. The controller of claim 1, wherein the compensation ratio operator generates a first compensation ratio when a ratio of a black grayscale level of the grayscale histogram is greater than a first threshold value and equal to or less than a second threshold value, and generates a second compensation ratio when a ratio of grayscale levels equal to or less than a reference grayscale level in the grayscale histogram is greater than a third threshold value.

11. The controller of claim 1, wherein the compensation ratio operator generates a first compensation ratio when a ratio of a black grayscale level of the grayscale histogram is greater than a first threshold value, and generates a second compensation ratio when a ratio of grayscale levels equal to or less than a reference grayscale level in the grayscale histogram is greater than a third threshold value.

12. A display apparatus comprising:

a controller to generate a second voltage code to drive pixels in the display apparatus by compensating zero-grayscale codes of a first voltage code to drive the pixels based on the zero-grayscale codes of the first voltage code, one-grayscale codes of the first voltage code, and input image data;

a data driver to generate a data voltage by using the second voltage code; and a display panel to display an image based on the data voltage, wherein the controller comprises:

a one-grayscale code extractor to extract the one-grayscale codes of the first voltage code;

a compensation range operator to determine range codes based on differences between the zero-grayscale codes of the first voltage code and the one-grayscale codes of the first voltage code;

a histogram analyzer to generate a grayscale histogram based on grayscale levels of frame data of the input image data; and a compensation ratio operator to determine a compensation ratio of the frame data based on a ratio of grayscale levels of the grayscale histogram.

13. The display apparatus of claim 12, wherein the controller comprises:

a voltage code generator to generate the first voltage code based on the input image data; and a voltage code compensator to generate the second voltage code by compensating the zero-grayscale codes of the first voltage code based on differences between the zero-grayscale codes of the first voltage code and the one-grayscale codes of the first voltage code, and the input image data.

14. The display apparatus of claim 13, wherein the voltage code compensator further comprises:

a zero-grayscale code operator to compensate the zero-grayscale codes by multiplying the range codes by the compensation ratio.

15. A method of driving a display panel, the method comprising the steps of:

generating a first voltage code to drive pixels in the display panel based on input image data;

generating a second voltage code to drive the pixels by compensating zero-grayscale codes of the first voltage code based on the zero-grayscale codes of the first voltage code, one-grayscale codes of the first voltage code, and the input image data, and generating a data voltage by using the second voltage code:

wherein the step of generating the second voltage code comprises:

extracting the one-grayscale codes of the first voltage code of pixels, determining range codes based on differences between the zero-grayscale codes of the first voltage code and the one-grayscale codes of the first voltage code, generating a grayscale histogram based on grayscale levels of frame data of the input image data, and determining a compensation ratio of the frame data based on a ratio of grayscale levels of the grayscale histogram.

16. The method of claim 15, wherein the step of generating the second voltage code further comprises:

compensating the zero-grayscale codes of the first voltage code by multiplying the range codes by the compensation ratio.

* * * * *